United States Patent [19]

Bergman et al.

[11] Patent Number: 4,754,463

[45] Date of Patent: Jun. 28, 1988

[54] HOLLOW ARC ELECTRODE

[75] Inventors: Kjell Bergman, Västerås; Erik Lassander, Viken, both of Sweden

[73] Assignee: Asea AB, Västerås, Sweden

[21] Appl. No.: 15,288

[22] Filed: Feb. 17, 1987

[30] Foreign Application Priority Data

Feb. 19, 1986 [SE] Sweden ..... 8600734

[51] Int. Cl.[4] ..... F27D 3/00; H05B 7/08

[52] U.S. Cl. ..... 373/93; 373/82

[58] Field of Search ..... 373/93, 82, 91, 92

[56] References Cited

U.S. PATENT DOCUMENTS

| | | | |
|---|---|---|---|
| 2,600,823 | 6/1952 | Zaccagnini | 373/93 |
| 3,940,551 | 2/1976 | Ling et al. | 373/82 |
| 4.039,738 | 8/1977 | Beskin et al. | 373/82 |
| 4,146,390 | 3/1979 | Widell | 373/82 |
| 4,509,178 | 4/1985 | Lades | 373/93 |

*Primary Examiner*—Roy N. Envall, Jr.

*Attorney, Agent, or Firm*—Kenyon & Kenyon

[57] ABSTRACT

A hollow arc furnace electrode comprises a central channel formed in its upper part as a tube and in its lower part as a passage extending through a graphite tip of the electrode. A metallic electrode portion is arranged around the central tube above the tip, which electrode portion is provided with channels for liquid coolant flow.

5 Claims, 1 Drawing Sheet

HOLLOW ARC ELECTRODE

TECHNICAL FIELD

The present invention relates to an electrode provided with a central channel for an arc furnace, preferably for a d.c. arc furnace. The central channel can be used for feeding metals in powdered or particulate form, such as materials (e.g. oxides)containing iron, chromium, nickel,etc., as well as reducing and/or refining agents for use in the furnace. A furnace for directing current which could usefully utilize an electrode according to this invention is described in Ling U.S. Pat. No. 3,940,551 assigned to the assignee of this application.

One problem in connection with hollow arc electrodes of the above-mentioned kind is the loss of electrode material due to the lateral burn-off which occurs during use. While it is known in solid arc electrodes to arrange liquid coolant channels inside a refractory compound in an outer portion of the electrode, the main object of this known arrangement is to prevent flashover of the arc and to increase the life of the electrode.

In connection with hollow arc electrodes, the problem is different because of the central passage which allows charge feeding of metals or metal oxides, such as iron oxides, reducing and/or refining agents such as lime, coke, etc..

SUMMARY OF THE INVENTION

One object of this invention is to provide a solution to the above-mentioned problems and other problems associated therewith. A hollow arc electrode according to the invention is characterized in that the central channel is formed in its upper part as a tube and in its lower part as a channel formed in a lower tip of electrically conducting material. A metallic electrode portion provided with cooling channels is arranged around the tube, behind the tip. In this way, it is found that lateral burn-off is reduced and the useful life of the electrode is increased while at the same time the facility to feed material into the arc through the central tube may continue undisturbed as required. thus the charging operation of the furnace may proceed with continued furnace heating. In addition, an electrode according to the invention permits an eroded electrode tip to be rapidly replaced by a new one.

BRIEF DESCRIPTION OF THE DRAWING

The invention will be exemplified in greater detail, by way of example, with reference to the accompanying drawing, wherein.

DESCRIPTION OF PREFERRED EMBODIMENT

Figure 1:
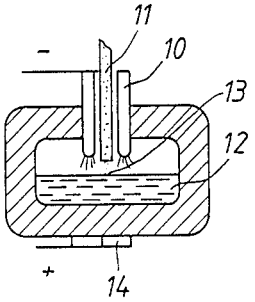
FIG. 1 is a schematic sectional side elevation of a d.c. arc furnace with a hollow arcing electrode.

FIG. 1 shows a d.c. arc furnace with a cathodically connected arcing electrode 10 having a central channel 11 for feeding a charge, such as Fe, Cr or Ni etc. and their oxides (ore concentrate, dust, etc.) as well as reducing and/or refining agents, such as lime and/or coke, or other deoxidants into the furnace.

The charge fed down the central channel 11 is supplied to the arcing spot 13 on the surface of the melt 12 in the furnace. Usually the spot 13 is a slag-free portion of the melt surface. As mentioned above, the type of furnace shown in FIG. 1 is already well known. The invention can also be applied to a.c. arc furnaces having electrodes provided with central channels for feeding material into the furnace.

Figure 2:
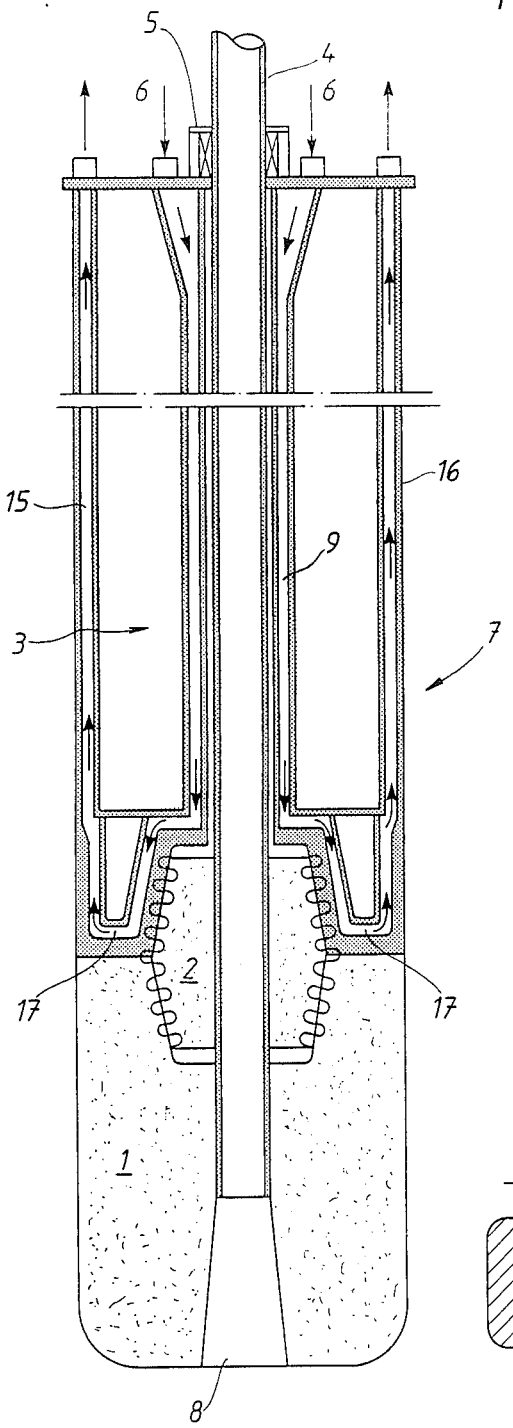
FIG. 2 shows one embodiment of hollow arc electrode according to the invention, also shown in sectional side elevation.

FIG. 2 shows a preferred form of hollow arc electrode (7) for a d.c. arc furnace. The number of electrodes per furnace may be one or more, and the or each electrode is negatively connected. The positive connection—i.e. a hearth connection—is shown schematically at 14 in FIG. 1.

The electrode 7 is provided with a channel passing through the electrode all the way to its graphite tip 1. The channel is defined in its upper part by a central tube 4 and in its lower part by a passage 8 formed in the tip 1. Thus the tube 4 opens out into the passage 8 in the tip.

The tip 1 is detachably and replaceably attached to the rest of the electrode by means of a screw-threaded nipple 2 which isscrew-threaded into the lower end of a metallic tubular part 3 of the electrode.

The tip 1 which could be of any convenient refractory electrically-conducting material, is connected to the metallic part 3 of the electrode, which is provided with one or more coolant channels 9 for circulating liquid coolant (e.g. cooling water) around and near the tube 4, and with one or more coolant channels 15, communicating with the channels 9, for recirculating the coolant to the inside of the outer peripheral surface 16 of the metallic part. The circulation directions for hecoolant are indicated by the arrows in Figure2. Thechannels 9 and 15 can be annular channels linked at their lower ends by radially extending link channels 17.

The material supply tube 4 is gas-tightly connected (at 5) to the upper end of the metallic part 3 of the electrode 7. This seal is provided to prevent the ingress of oxygen (e.g. air) into the charge, and the unwanted egress of fumes from the furnace.

A charge, such as a metallic material containing iron oxide or an iron-containing material, as well as reducing and/or refining agents (lime, Al, coke) is supplied through the tube 4 to the melt bath in the furnace. To prevent backward movement of the powdered material, injection of a carrier gas via an ejector (not shown) can be arranged at a suitable part of the transport path, for example at the upper end of the tube 4, above the metallic part 3 of the electrode. The provision of a metallic part 3 of the electrode, which is provided with cooling, considerably reduces the lateral burn-off of the electrode during use of the latter.

The material is suitably charged through the tube 4 and the passage 8 while arc heating via the electrode is taking place.

The design of the electrode shown in FIG. 2 can be varied in many ways within the scope of the following claims. Thus the cooling channels (9, 15, 17) can be differently arranged, provided they achieve good cooling of the tube 4, the tip 1 and the outer periphery 16 of the part 3. The screw-threaded plug 2 need not be of graphite and need not be separate from the tip 1. The part 3 can be made of non-magnetic material, such as copper, aluminum or stainless steel.

What is claimed is:

1. An arc furnace electrode provided with a central channel for feeding material into the furnace, wherein the electrode comprises a central tube, a distal tip of electrically conducting material and an electrode portion having an outer peripheral surface, characterized in that the central tube defines the channel at its upper part and a passage formed in the distal tip at its lower part, a metallic electrode portion being arranged around the central tube and above the distal tip and providing cooling channels which (a) allow circulation of liquid coolant around the central tube and (b) allow for coolant circulation adjacent to the peripheral surface of the electrode portion for cooling of the said peripheral surface.

2. An arc furnace electrode as claimed in claim 1, in which the distal tip is a block of graphite electrically connected to the electrode portion.

3. An arc furnace electrode as claimed in claim 2, in which the distal tip is screw-threaded to an electrically conducting nipple which surrounds the central tube, the electrode portion also being screw-threaded to the nipple.

4. An arc furnace electrode as claimed in claim 1, in which cooling channels are arranged in the metallic electrode portion for circulation of liquid coolant past an inner portion of the metallic electrode which is located closest to the central tube and one or more further cooling channels are arranged for circulation of liquid coolant past the inside of the peripheral surface of the metallic electrode.

5. An arc furnace electrode as claimed in claim 1, in which the central tube is gas-tightly connected to an upper end of the cooled metallic electrode portion.

* * * * *